United States Patent [19]

Endicott, Jr. et al.

[11] 4,315,651

[45] Feb. 16, 1982

[54] COUPLING FOR QUICK ATTACHMENT TO PLATE-LIKE STRUCTURE

[75] Inventors: Donald L. Endicott, Jr.; James M. Walton; Robert L. Wernli, all of San Diego, Calif.

[73] Assignee: The United States of America as represented by the Secretary of the Navy, Washington, D.C.

[21] Appl. No.: 137,026

[22] Filed: Apr. 3, 1980

[51] Int. Cl.[3] ..... B63C 7/16; B66C 1/34

[52] U.S. Cl. ..... 294/83 R; 24/201 A; 24/221 K; 294/93; 411/349

[58] Field of Search ..... 294/66 R, 81 SF, 82 R, 294/83 R, 89, 93, 97; 24/201 A, 221 R, 221 A, 221 K; 248/317, 322, 339, 343, 499, 510; 292/62; 403/252, 316, 317, 323, 325; 410/82, 83, 107, 111; 269/47-52; 411/347-350, 544

[56] References Cited

U.S. PATENT DOCUMENTS

| | | | |
|---|---|---|---|
| 2,311,592 | 2/1943 | Hapanowicz | 24/221 A X |
| 2,378,122 | 6/1945 | Barlow | 24/221 K |
| 3,159,393 | 12/1964 | Villano | 24/221 K X |
| 3,381,925 | 5/1968 | Higuchi | 24/201 A X |
| 3,456,967 | 7/1969 | Tantlinger et al. | 410/82 X |
| 3,594,876 | 7/1971 | Gunther | 24/221 K |
| 3,747,168 | 7/1973 | Snarskis | 24/221 R |
| 3,972,554 | 8/1976 | Tryon | 294/66 R X |

FOREIGN PATENT DOCUMENTS

| | | | |
|---|---|---|---|
| 1805530 | 11/1969 | Fed. Rep. of Germany | 294/81 SF |

*Primary Examiner*—Johnny D. Cherry

*Attorney, Agent, or Firm*—Richard S. Sciascia; Ervin F. Johnston; James O. Skarsten

[57] ABSTRACT

A coupling which is readily attachable to a plate, panel or like structure includes a rotatable shaft for thrusting a bearing element through a circular hole in the structure when the bearing element and the hole are in concentric relationship. Thereafter, the shaft is rotated by less than a complete revolution to bring the bearing element and the hole into a selected eccentric relationship, and also to activate a locking mechanism to maintain the eccentric relationship. When the bearing element and hole are in the eccentric relationship, a bearing surface of the bearing element abutts the structure to impose substantial force thereupon.

14 Claims, 10 Drawing Figures

COUPLING FOR QUICK ATTACHMENT TO PLATE-LIKE STRUCTURE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention disclosed and claimed herein generally pertains to the field of coupling devices of the type which may be rapidly attached to a structure by means of a few, simple motions. More particularly, the invention pertains to the field of devices of the above type which are employed to couple substantial forces to a plate-like structure, i.e. a structure having a thickness which is small in relation to its surface area. Even more particularly, the invention pertains to coupling devices of the above type, wherein a device is attached by means of a single linear movement, which thrusts the device into and through a circular hole through the structure, and a subsequent rotational movement of less than a complete revolution to prevent the device from being pulled back through the hole, even when a substantial force is applied to the device.

There is increasing interest in the use of remotely controlled underwater work systems for performing a variety of mechanical tasks in an underwater environment. In an important class of such tasks, for example, in underwater salvage operations, it is necessary to attach cables or other structure to underwater objects to impart substantial forces thereto. In such operations, the viewability of a work site, through an underwater TV camera, as well as control of tools located at the site, may be very limited for a remotely located operator. Consequently, it is extremely important that the task of attaching a lifting cable to an underwater object be performed with as few discrete mechanical operations as possible.

In addition to the above requirement, it is very likely in underwater salvage that it will be necessary to attach a lifting cable to a plate or panel-like structure wherein only one side of the structure is accessible.

To recover an object such as a sunken craft which has no component to which a lifting cable may be readily attached, it has generally been necessary to use slings, grapples or nets, techniques which tend to be very cumbersome, slow and frequently ineffective. It has been considered that a remotely controlled work system could be employed to bore circular holes through plate-like components of an object to be salvaged, and then insert coupling devices therethrough of the type which may be secured to a plate by performing tasks on only one side of the plate. However, conventional devices of such type, such as toggle bolts, have been found to be unacceptable for supporting weight which may be on the order of several thousand pounds. Alternatively, such devices may not be deployable in a plate-like structure without the performance of fairly complicated operations, such as perforating the structure with holes of non-circular cross-section, or may require that holes of unacceptably large diameter be drilled through the structure.

In the present invention, a coupling device is provided which may be employed to rapidly attach a lifting cable or other structure to a plate of selected thickness by means of a very limited number of simple mechanical operations. To attach the device it is only necessary to drill a circular hole through the plate, apply a single linear movement to the device to insert it through the hole, and apply a single rotational movement to the device to prevent its being pulled back through the hole, even when substantial force is applied thereto. The diameter of the hole which must be drilled is comparatively small in relation to a shaft which traverses the hole and which carries the force therethrough, to apply it to the far side of the plate. An embodiment of the device is generally recoverable and reuseable, and it is anticipated that the invention will be useful in a wide range of situations, wherever it is important to rapidly join a coupling device to a plate-like structure, or to join a coupling device to a plate-like structure having only one accessible side.

SUMMARY OF THE INVENTION

The present invention provides apparatus for coupling a selected force to a plate-like structure having a hole of selected diameter through it. The apparatus includes a bearing element means for traversing the structure from a first side to a second side of the structure, and flange means comprising a flange for abutting the first side of the structure, and a bushing which is fixably joined to the flange for insertion into the hole. A shaft means is provided which traverses the flange means and which has an end fixably joined to the bearing element means for positioning the bearing element means in a concentric relationship with the bushing, when the apparatus is in a first mode of operation, and for positioning the bearing element means in an eccentric relationship with the bushing, when the apparatus is in a second mode of operation. The apparatus further includes locking means for maintaining the bearing element means and the bushing means in the eccentric relationship when the apparatus is in its second mode of operation, means for providing a force to activate the locking means, and means for coupling the selected force to the shaft means.

Preferably, the bushing comprises a cylindrical member having first and second edges, the first edge being fixably joined to the flange, the bushing being provided with a slot of selected dimensions which is accessible through an opening in its second edge. Preferably also, the locking means includes a key fixably joined to the shaft means, the key being dimensioned in relationship to the slot so that the key is receivable into the slot, the shaft means comprising means for selectively positioning the slot and the key in a critical alignment. The activating means comprises a spring acting on the flange means and the shaft means to force the key into the slot when the key and the slot have been brought into the critical alignment.

In a preferred embodiment, the bearing element means comprises a plug which is insertable through the hole when the bearing element means and the bushing are in concentric relationship, the plug including a bearing surface which is in abuttable relationship with the second side of the structure when the plug and the bushing are in the above eccentric relationship. The bearing surface is capable of applying the above selected force to the structure to alternatively move it, or to support other structure therefrom.

The present invention also provides a method for applying a substantial force to a plate-like structure of selected thickness, the method comprising the steps of: passing a cylindrical bearing element through a circular hole in the structure from a first side to a second side thereof; rotating the bearing element through a selected angle so that a bearing surface of the bearing element is in a selected abutting relationship with the second side of the structure; activating a locking mechanism at the conclusion of the rotation to lock the bearing surface into the abutting relationship with the structure; and applying the substantial force to the bearing element.

OBJECTS OF THE INVENTION

An important object of the present invention is to provide a new and improved system for coupling a substantial force to a plate, panel, sheet of material, or other plate-like structure.

Another object is to provide a new and improved coupling which may be rapidly and securely attached to a plate-like structure from a single side of the structure.

Another object is to provide a coupling which may be attached to a plate-like structure, wherein the only operations necessary for attachment are a single linear movement to pass the coupling device through a circular hole in the structure, and a single rotational movement on the order of 180° or less.

Another object is to provide improved means for attaching lifting cables to a sunken craft, or other structure having plate-like components, which is the subject of underwater salvage operations.

Another object is to provide a coupling device which may be readily deployed by means of a remotely controlled mechanical work system.

These and other objects will become more readily apparent from the ensuing specification when taken together with the drawings.

DETAILED DESCRIPTION OF THE PREFERRED EMBODIMENT

Figure 1:
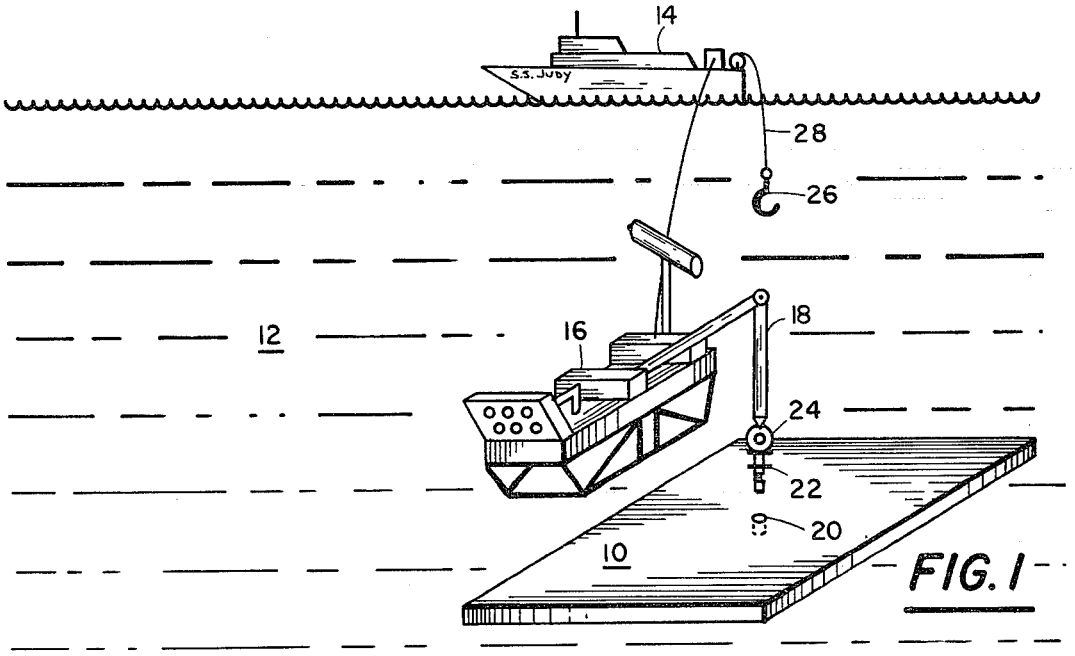
FIG. 1 is a perspective view showing an important application of an embodiment of the invention.

Referring to FIG. 1, there is shown a plate-like structure 10 submerged in an underwater environment 12. Plate-like structure 10 generally comprises any structure having a thickness which is comparatively small in relation to its surface area, and is generally flat, although it is anticipated that the invention could also be employed with a structure 10 having some curvature. Structure 10 comprises, for example, one of the plates of a craft which has sunk into an underwater environment 12, and which is the object of salvage therein.

Referring further to FIG. 1, there is shown a command vessel 14 on the surface of environment 12, an underwater work system 16 being tethered thereto and controllable therefrom. Underwater work system 16 usefully comprises the Navy's Work Systems Package (WSP), mounted on a remotely controlled vehicle such as the Navy's CURV-III or RUWS. A mechanical arm 18 of system 16 is controllable by an operator aboard vessel 14 to perform a variety of simple mechanical tasks, such as wielding tools to drill a circular hole 20 through structure 10, or controlling movement of an object adjacent to structure 10. Work arm 18 may therefore be manipulated to insert a coupling device 22, comprising an embodiment of the present invention, through hole 20, and then rotate some parts of the coupling through a selected angle, which may be on the order of 180°. Coupling 22 is structured so that upon such rotation, it becomes fixably joined to structure 10. Coupling 22 is provided with a lifting eye or padeye 24, which is sized to receive a hook 26 attached to a cable 28, whereby structure 10 may be subjected to a force sufficient to raise it up out of environment 12.

Figure 2:
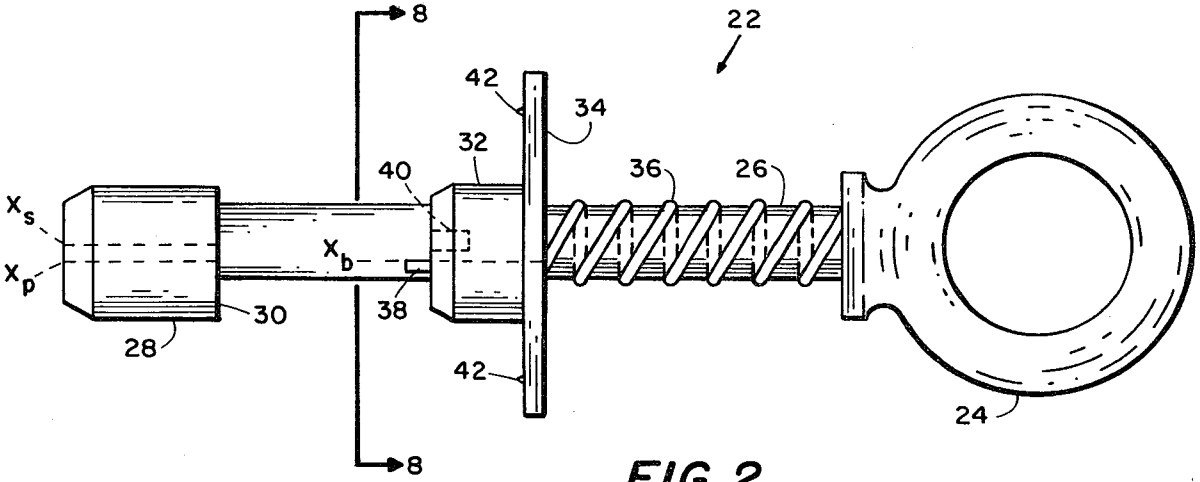
FIG. 2 is a view showing the embodiment of FIG. 1 in greater detail.

Referring to FIG. 2, there is shown coupling 22 comprising, in addition to padeye 24, a shaft 26, of circular cross-section, having one end immovably joined to padeye 24 and another end immovably joined to a cylindrical plug 28. Plug 28 has a diameter which is slightly less than the diameter of hole 20 and the end thereof is tapered, allowing plug 28 to readily pass through hole 20, from one side of structure 10 to the other. Cylindrical plug 28 has a flat, upper surface 30, fixably joined to shaft 26, for providing a bearing surface for transferring force to structure 10, after the aforementioned rotation has occured. Shaft 26 and plug 28 are joined so that their respective axes, $X_s$ and $X_p$ respectively, are non-aligned, or, in other words, so that shaft 26 and plug 28 are joined together in an eccentric relationship.

Referring further to FIG. 2, there is shown shaft 26 passing through a cylindrical bushing 32 so that bushing 32 and shaft 26 always have an eccentric relationship, their respective axes, $X_s$ and $X_b$ being non-aligned. Shaft 26 is rotatable in relation to bushing 32, so that plug 28 and bushing 32 may be selectively brought into either concentric or eccentric relationship with one other.

FIG. 2 also shows a flange 34 joined in immovable relationship to one end or edge of bushing 32, shaft 26 passing therethrough in rotatable relationship therewith. Flange 34 is usefully circular and has a diameter which is large in comparison with the diameter of bushing 32, bushing 32 and flange 34 usefully comprising a single machined part. Since shaft 26 is rotatable in relation to both bushing 32 and flange 34, and since padeye 24, shaft 26 and plug 28 are joined together in immovable relationship, a selected rotation of eye 24 with respect to flange 34 and bushing 32 causes a like rotation of shaft 26 and plug 28. In like manner, linear movement of eye 24 in relation to flange 34 and bushing 32 causes like linear motion of shaft 26 and plug 28.

Referring again to FIG. 2, there is shown a spring 36 placed around the upper portion of shaft 26 and compressed between eye 24 and the upper surface of flange 34. The compression of spring 36 is maintained by a key 38, which is of selected shape, which is immovably joined to the outer surface of shaft 26 and which projects outwardly therefrom. When key 38 is in an abutting relationship with the lower edge of bushing 32, as shown in FIG. 2, padeye 24 is prevented from moving away from flange 34 to release spring 36.

In order to allow selective, controlled release of spring 36, bushing 32 is provided with a slot or other cavity 40, which is dimensioned in relationship with key 38 so that key 38 may be accommodated thereby, or be receivable thereinto. By so providing, a single rotation of shaft 26 is sufficient to align key 38 and slot 40. Thereupon, compressed spring 36 is enabled to expand, moving padeye 24 away from flange 34 and drawing key 38 into slot 40. Key 38 and slot 40 are dimensioned in relation to one another so that after key 38 has been drawn into, or received by, slot 40, only negligible rotational movement can take place between bushing 32 and flange 34 on the one hand, and shaft 26, plug 28 and eye 24 on the other.

FIG. 2 shows several pointed, spaced apart studs 42 joined to the lower side of flange 34, for purposes hereinafter described.

Figure 3:
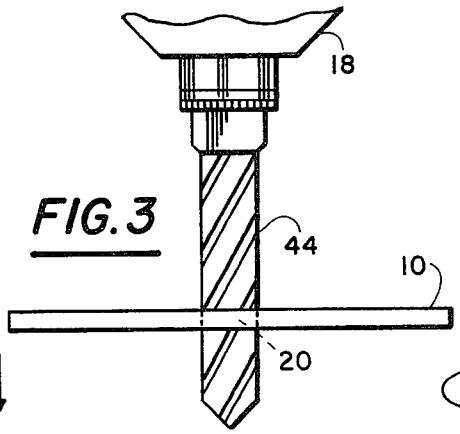
FIGS. 3–7 are views illustrating successive steps in deploying the embodiment of FIG. 1.

Referring to FIG. 3, there is shown a first step in attaching coupling 22 to structure 10. In such step a drilling tool 44 is manipulated to bore circular hole 20 through structure 10. Drilling tool 44 is part of the standard equipment of work package 16, and is readily manipulated by mechanical arm 18.

Figure 4:
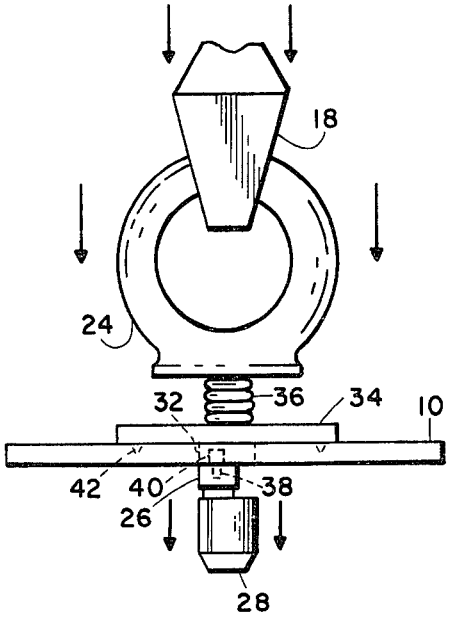

Referring to FIG. 4, there is shown a second step in the attachment of coupling 22. Therein, mechanical arm 18 grasps padeye 24, and in a single linear motion, thrusts plug 28 through hole 20, inserts bushing 32 into hole 20, and brings pointed studs 42 into abutting relationship with structure 10. During such motion, plug 28 and bushing 32 are, of necessity, in concentric relationship. Key 38 is joined to shaft 26 so that key 38 and slot 40 are in a non-aligned relationship when plug 28 and bushing 32 are in concentric relationship. Spring 36 is therefore compressed between padeye 24 and flange 34 during such second step.

Figure 5:
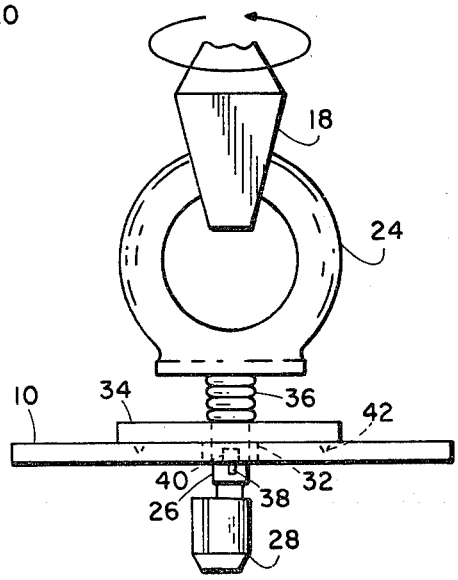
Figure 6:
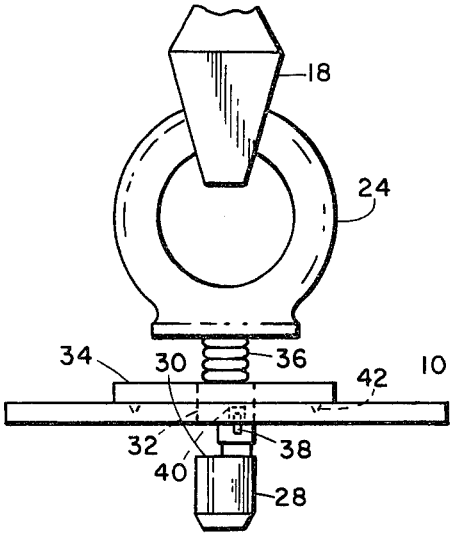

Referring to FIGS. 5–6, there is shown the third step in the deployment of coupling 22, wherein mechanical arm 18 is operated to rotate padeye 24. Studs 42, abutting structure 10 as aforementioned, engage structure 10 sufficiently to prevent flange 34 and bushing 32 from turning as padeye 24, shaft 26 and plug 28 are rotated. Consequently, key 38 moves from a non-aligned relationship with slot 40 into aligned relationship therewith. When key 38 and slot 40 become aligned, spring 36 is released, and stretches out to draw key 38 into slot 40, as aforementioned.

Figure 7:
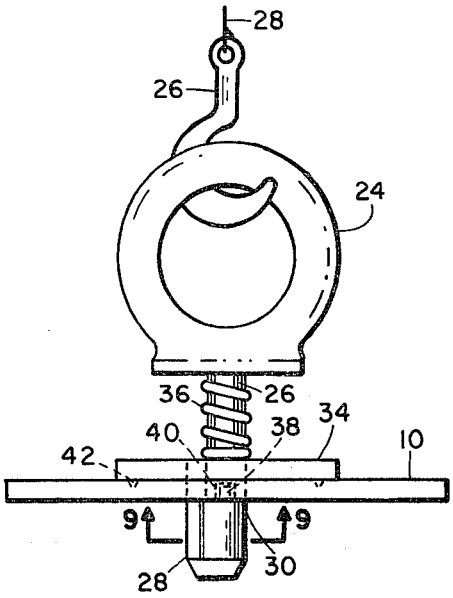

Referring to FIG. 7, there is shown spring 36 fully extended, and key 38 fully received into slot 40, whereby eye 24, shaft 26 and plug 28 are locked into immovable relationship with bushing 32 and flange 34. It will be readily apparent that since plug 28 is in concentric relationship with hole 20 when it is passed therethrough, any rotation of plug 28 will bring plug 28 into eccentric relationship with hole 20, and will bring bearing surface 30 of plug 28 into abutting relationship with the under side of structure 10. If plug 28 is locked into such eccentric relationship with hole 20, it cannot be drawn back therethrough unless spring 36 is recompressed, and then maintained in a state of compression while shaft 26 is rotated, at least slightly. However, if hook 26 is passed through eye 24, and lifting force applied thereto to raise structure 10, such succession of events is impossible or extremely unlikely. Rather, the lifting force is transferred through shaft 26 to bearing surface 30 of plug 28, to impart the force to the under side of structure 10.

It is anticipated that by judicious selection of respective dimensions of plug 28 and bushing 32, and of respective positionings for key 38 and slot 40, the bearing surface 30 which abutts structure 10 when key 38 is received into slot 40 will be sufficient to impart or transmit a lifting force on the order of several thousand pounds to structure 10.

Figure 8:
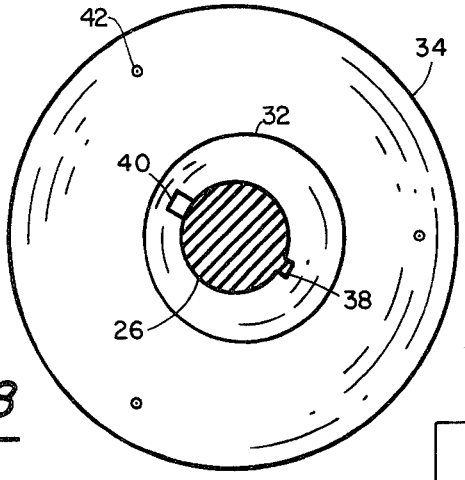
FIG. 8 is a cross-sectional view taken along lines 8—8 of FIG. 2.

Referring to FIG. 8, there is shown shaft 26 passing through flange 34 and bushing 32 in eccentric relationship, key 38 and slot 40 being non-aligned.

Figure 9:
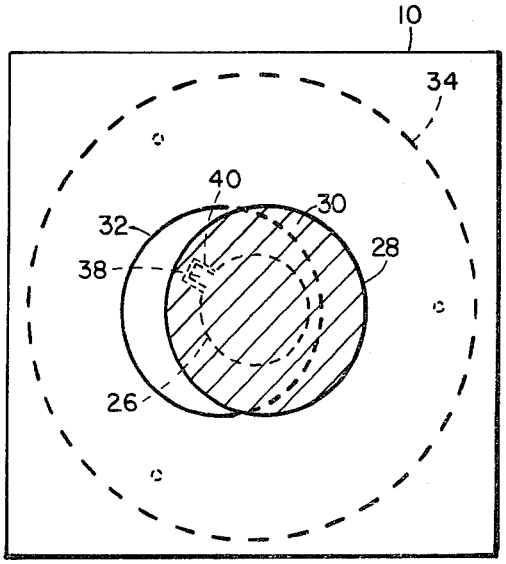
FIG. 9 is a cross-sectional view taken along lines 9—9 of FIG. 7.

Referring to FIG. 9, there is shown plug 28 locked in a selected eccentric relationship with bushing 32, to provide an optimal bearing surface 30 for lifting structure 10.

Figure 10:
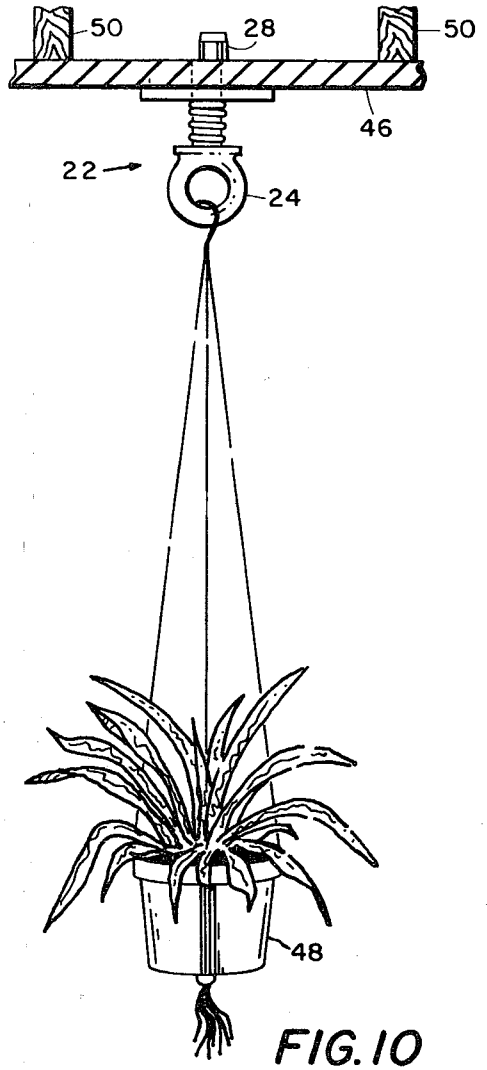
FIG. 10 is a perspective view showing an alternative application of the embodiment of FIG. 1, to illustrate the broad utility of applicants' invention.

Referring to FIG. 10, there is shown coupling 22 inserted through a circular hole drilled through a ceiling 46, and deployed to prevent its removal therefrom, in the aforementioned manner. An object 48, such as a hanging basket or other plant container, is suspended therefrom. It will be readily apparent that by employing coupling 22, object 48 may be securely suspended from ceiling 46 without the need to locate ceiling joists 50.

It is anticipated that the dimensions of the respective components of a coupling device structured according to the principals of the afore-described invention will be readily determinable by one of skill in the art according to the requirements of a particular application thereof. It is to be noted that respective components of the invention may be modified as appropriate for a particular application. For example, shaft 26 may be directly attached to lifting cable 28.

Obviously, many other modifications and variations of the present invention are possible in the light of the above teachings, and, it is therefore understood that within the scope of the disclosed inventive concept, the invention may be practiced otherwise than as specifically described.

What is claimed is:

1. Apparatus for coupling a selected force to a plate-like structure, there being a circular hole of selected diameter through said structure, said apparatus comprising:

a bearing element means for traversing said structure from a first side of said structure to a second side of said structure, flange means comprising a flange for abutting said first side of said structure, and a bushing which is fixably joined to said flange for insertion into said hole;

shaft means which traverses said flange means and the bushing, the traversal of the bushing being eccentric thereto, and which has an end fixably joined to said bearing element means for positioning said bearing element means in a concentric relationship with said bushing when the shaft means is rotated in the bushing to a first position and for positioning said bearing element means in an eccentric relationship with said bushing when the shaft means is rotated in the bushing to a second position;

the shaft means and bushing having locking means for maintaining said bearing element means and said bushing in said eccentric relationship when the shaft means is rotated to said second position; and spring means biasing the bearing element means toward the bushing for activating said locking means when the shaft means is rotated to said second position; and means for coupling said selected force to said shaft means.

2. The apparatus of claim 1 wherein:

said bearing element means comprises a plug which is insertable through said hole when said bearing element means and said bushing are in said concentric relationship, said plug including a bearing surface which is in abuttable relationship with said second side of said structure when said bearing element means and said bushing are in said eccentric relationship.

3. The apparatus of claim 2 wherein:

said bushing is cylindrical with first and second edges, said first edge being fixably joined to said flange;

said locking means including the cylindrical bushing being provided with a slot of selected dimensions which is accessible through an opening in said second edge;

said locking means further including a key fixably joined to said shaft means, said key being dimensioned in relationship to said slot so that said key is receivable into said slot when the shaft means is rotated to said second position;

the spring means acting on said flange means and said shaft means to force said key into said slot when the shaft means is rotated to said second position.

4. The apparatus of claim 3 wherein:

said bearing element means comprises a cylindrical plug having a diameter which is no greater than the diameter of said hole; and said shaft means comprises a rotatable shaft having a circular cross-section, said plug being fixably joined to an end of said shaft so that the axes of said plug and said shaft are maintained in fixed non-aligned relationship.

5. The apparatus of claim 4 wherein:

said cylindrical bushing has a hole which is eccentric with respect to the longitudinal axis of the cylindrical bushing:

said shaft means slidably passes through the hole in the cylindrical bushing so that the longitudinal axis of said shaft means and the longitudinal axis of said cylindrical bushing are in a fixed non-aligned relationship, said shaft means being rotatable through one half of a revolution to bring the axes of said plug and of said cylindrical bushing into aligned relationship when the shaft means is rotated to said first position and for bringing the axes of said plug and of said bushing into a selected non-aligned relationship when the shaft means is rotated to said second position.

6. The apparatus of claim 5 wherein:

the flange means has a plurality of pointed studs on the side of the flange which abuts said first side of the structure.

7. The apparatus of claim 6 wherein:

said means for coupling said selected force to said shaft means comprises a padeye immovably joined to said shaft means, said padeye being capable of receiving a lifting hook of specified dimensions.

8. A coupling apparatus for a plate-like structure which has a hole comprising:

a shaft which is capable of longitudinally extending through the hole;

an elongated plug eccentrically affixed to one end of the shaft and attachment means fixed to the other end of the shaft, the plug being sized to longitudinally extend through said hole;

an elongated bushing eccentrically mounted to the shaft for slidable movement therealong and thereabout, the bushing being sized to longitudinally extend within the hole;

a flange mounted to the bushing for lateral engagement with the plate-like structure when the bushing is inserted in the hole so that when the plug is extended through the hole and the bushing is extended into the hole the shaft can be rotated to capture the plate-like structure between the flange and the plug;

the bushing and the shaft having means for locking the relative rotation therebetween when the shaft has been rotated in the bushing to a predetermined position; and spring means mounted between the flange and the attachment means for biasing the flange toward the plug so that the flange and the plug can tightly engage the plate-like structure therebetween.

9. A coupling apparatus as claimed in claim 8 including:

said predetermined position between the shaft and the bushing being located where the cross-sectional areas of the bushing and the plug are in maximum misalignment.

10. A coupling apparatus as claimed in claim 9 including:

the locking means being a slot and key; and the spring means forcing the key into the slot when the shaft has been rotated in the bushing to said predetermined position.

11. A coupling apparatus as claimed in claim 10 including:

the key being mounted on the shaft and extending therebeyond to engage an edge of the bushing so that the bushing is maintained against the spring force in a spaced relationship from the plug; and the slot being located in an interior side of the bushing adjacent the shaft for receiving the key when the shaft has been rotated in the bushing to said predetermined position.

12. A coupling apparatus as claimed in claim 11 for a plate-like structure having a circular hole, said apparatus including:

the shaft, bushing, and plug being substantially cylindrical; and the cross-sectional areas of the bushing and the plug being substantially identical.

13. A coupling apparatus as claimed in claim 12 including:

the flange having a plurality of studs for engaging the plate-like structure to prevent relative rotation therebetween.

14. A coupling apparatus as claimed in claim 13 including:

the attachment means being a padeye; and the spring means being a compression spring which is located about the shaft between the padeye and the flange.

* * * * *